US005183517A

United States Patent [19]

Yasumura et al.

[11] Patent Number: 5,183,517

[45] Date of Patent: Feb. 2, 1993

[54] PERMANENT MAGNET COMPOSITION

[75] Inventors: Takaaki Yasumura; Teruo Kiyomiya, both of Kosai; Yasutoshi Mizuno; Kazuo Matsui, both of Toyohashi, all of Japan

[73] Assignee: Fuji Electrochemical Co., Ltd., Tokyo, Japan

[21] Appl. No.: 759,130

[22] Filed: Sep. 11, 1991

Related U.S. Application Data

[63] Continuation of Ser. No. 446,622, Dec. 6, 1989, abandoned.

[30] Foreign Application Priority Data

Dec. 8, 1988 [JP] Japan ..... 63-308720

[51] Int. Cl.[5] ..... H01F 1/04

[52] U.S. Cl. ..... 148/303; 420/435; 420/582

[58] Field of Search ..... 148/303; 420/435, 582

[56] References Cited

U.S. PATENT DOCUMENTS 4,289,549 9/1981 Kasai ..... 148/303

FOREIGN PATENT DOCUMENTS 56-46508 4/1981 Japan ..... 148/303

57-118604 7/1982 Japan ..... 148/303

*Primary Examiner*—John P. Sheehan

*Attorney, Agent, or Firm*—Barnes & Thornburg

[57] ABSTRACT

An improved permanent magnet composition comprising 22 to 28 wt % R, 5 to 16 wt % iron, 0.2 to 6.5 wt % copper, 0.1 to 6 wt % manganese, 0.5 to 6 wt % A, 0.1 to 2 wt % B and the balance cobalt, in which R is at least one of rare earth elements including yttrium, A is at least one of zinc and zirconium and B is at least one element selected from the group of aluminum, bismath and thallium.

2 Claims, No Drawings

PERMANENT MAGNET COMPOSITION

This application is a continuation of application Ser. No. 07/446,622 filed on Dec. 6, 1989, now abandoned.

BACKGROUND OF THE INVENTION

1. Field of the Invention

The present invention relates to $R_2M_{17}$ (where R represents at least one of rare earth elements including yttrium and M is mainly transition metals) type permanent magnet composition and, more particularly, to the $R_2M_{17}$ type permanent magnet composition whose energy product is improved by increasing its residual magnetic flux density while maintaining its coercive force at a level equal to that obtainable in the prior art.

2. Description of Prior Art

In conventional $R_2M_{17}$ type permanent magnets using samarium as the rare earth element R and cobalt as the transition metal M the copper content is relatively large, above 10 weight percent, to obtain high coercive force (iHc) and iron is added to suppress deterioration of residual magnetic flux density (Br) which is caused when the copper content becomes large. In this instance, the amount of iron added is held less than about 8 weight percent, because the iron, if added in large quantity, would lower the residual magnetic flux density (Br).

However, the energy product (BH) obtainable with such a permanent magnet composition is only 22.1 MG.Oe or so at the largest.

To increase the energy product (BH), a variety of permanent magnet compositions have been proposed so far.

Of the proposed compositions, (1) a composition which contains 22 wt % R, 5 to 12 wt % copper, 0.2 to 5 wt % X (which is at least one of niobium, zirconium, vanadium, tantalum, chromium, hafnium), 0.2 to 8 wt % manganese and the balance being cobalt which is substituted by less than 35 wt % iron (Japanese Patent Publication No. 56-11378), (2) a composition which contains 22 to 28 wt % R, 2 to 10 wt % copper, 6 to 35 wt % T (which is at least one of iron manganese and chromium), 0.5 to 6 wt % M (zirconium and/or hafnium) and the balance being cobalt (Japanese Patent Publication No. 62-61665), and (3) a composition which is represented by the formula R $(Co_{1-u-v-w}Cu_uFe_vM_w)_z$ where $0<u\leqq 2$, $0.01<v\leqq 0.6$, $0.005\leqq w\leqq 0.05$, $6.5\leqq z\leqq 8.8$, and M is at least one element selected from the group consisting of tantalum, zirconium, niobium, titanium and hafnium (Japanese Patent Publication No. 61-17881) are high in both coercive force and residual magnetic flux density, and consequently, provide a great energy product.

All these compositions reduce the copper content but instead call for the addition of such expensive and difficult-to-get elements as tantalum, niobium and hafnium—this inevitably leads to advanced cost of material and hence eventually raises the manufacturing costs of products. Moreover, these compositions are all intended to provide a greater energy product by increasing both of the coercive force and the residual magnetic flux density. However, depending on the elements used, the coercive force increases while decreasing the residual magnetic flux density and vice versa as referred to above. Accordingly, it is very difficult to determine the particular composition which can raise both of characteristics.

SUMMARY OF THE INVENTION

It is therefore an object of the present invention to provide $R_2M_{17}$ type permanent magnet composition which reduces a copper content but instead uses low-cost, easily available elements and which provides a greater energy product by increasing a residual magnetic flux density while maintaining a coercive force at a level substantially equal to that in the prior art composition.

To attain the above objective, a permanent magnet composition of the present inventon comprises 22 to 28% R (Where R represents at least one of rare earth elements including yttrium), 5 to 16% iron, 0.2 to 6.5% copper, 0.1 to 6% manganese, 0.5 to 6% A (where A represents at least one of zinc and zirconium), and 0.1 to 2% B (where B represents at least one of aluminum, bismuth and thallium) by weight, with the balance being cobalt.

DESCRIPTION OF THE PREFERRED EMBODIMENTS

According to the present invention, the amount of copper, which is requisite to the $R_2M_{17}$ type permanent magnet composition, as well as R, iron and cobalt, is held small, i.e. between 0.2 and 6.5 weight percent. Instead, manganese, at least one of zinc and zirconium of the group A materials and at least one of aluminum, bismuth and thallium of the group B materials are added.

The zinc in group A and the aluminum in group B are low-cost and easily available and involves no significant difficulty in handling as is well known. With the permanent magnet composition of the present invention which substitutes the zinc and aluminum for the aforementioned hafnium, niobium, tantalum etc which are expensive, difficult to obtain and must be handled carefully, the coercive force (iHc) is about the same as that in the prior art compositions but the residual magnetic flux density (Br) is enhanced, providing for increased energy product, as will be seen from examples described later.

Incidentally, even if the zinc is partially or wholly replaced with the zirconium and the aluminum is partially or wholly replaced with bismuth and/or thallium, the same result can be obtained as described later.

The amount of the group A element should be between 0.5 and 6 weight percent because when its amount is less than 0.5 weight percent the coercive force is low, whereas when the amount exceeds 6.5 weight percent the residual magnetic flux density appreciably decreases and the coercive force also decreases.

If the group B element is greater than 2 weight percent, the residual magnetic flux density is not improved and the coercive force becomes lower than in the past. On the other hand, if the element is less than 0.1 weight percent, no effect is produced. Therefore, the amount of group B element must be in the range of 0.1 and 2 weight percent.

The reason the amount of the R is selected in the range of between 22 and 28 weight percent is that, if its amount is greater than 28 weight percent, the residual magnetic flux density decreases and hence its improvement (which is the object of the invention) cannot be attained, whereas when the amount of the R is less than 22 weight percent, the coercive force does not reach the value obtainable in the prior art compositions.

The manganese is added in amounts between 0.1 and 6 weight percent because no effect is produced if the manganese is less than 0.1 weight percent, whereas if it is greater than 6 weight percent, the coercive force and the residual magnetic flux density both decrease.

The copper should be added in amounts between 0.2 and 6.5 weight percent. If the copper is greater than 6.5 weight percent, the residual magnetic flux density lowers. On the other hand, if the copper content is less than 0.2 weight percent, the coercive force does not reach about the same level as in the prior art.

The iron is present in amounts between 5 and 16 weight percent. When the iron content is greater than 16 weight percent, the coercive force lowers as compared with that in the prior art. Also, if it is less than 5 weight percent, the residual magnetic flux density decreases.

The above-mentioned composition in accordance with the present invention are melted and casted into an ingot, which is finely pulverized into a powder. The powder is compression-molded into a desired shape at a pressure of 0.5 to 5 tons/cm$^2$ in a magnetic field having a field intensity between 5 and 16 kOe, thereafter the molding being subjected to the following heat treatment.

That is, the molding is sintered at 1180° to 1250° C. for 1 to 10 hours, solution-treated at 1100° to 1240° C. for 0.5 to 10 hours, subjected to a first aging treatment at 400° to 800° C. for 0.5 to 5 hours and a second aging treatment at 750° to 950° C. for 0.5 to 5 hours, and then cooled down to 600° C. or below at a rate of 0.1° to 4° C./min.

In this way, a permanent magnet is obtained which has a coercive force about the same as that in the prior art composition but provides a greater energy product.

EXAMPLE 1

Alloys of 24.1 wt % samarium, 3.9 wt % copper, 2.3 wt % zinc, 12.9 wt % iron, 2 wt % manganese, aluminum in amounts given in Table 1 and the balance cobalt were melted in a high-frequency melting furnace and roughly ground by a jaw crusher, thereafter being finely pulverized by a jet mill. The finely pulverized powders were compression-molded under a pressure of 3 tons/cm$^2$ in a magnetic field of 15 KOe field intensity. Then the moldings were sintered at 1180° to 1250° C. for 5 hours, solution-treated at 1100° to 1240° C. for 5 hours, and subjected to a first aging treatment at 700° C. for 2 hours and a second aging treatment at 900° C. for 3 hours. Finally, the moldings were cooled down to 400° C. at a rate of 0.5° C./min.

The characteristics of the permanent magnets thus obtained are given in Table 1.

TABLE 1

| Al (wt %) | 0.5 | 1.0 | 1.5 | 2.0 | 2.5 |
|---|---|---|---|---|---|
| iHc (kOe) | 10.92 | 10.81 | 10.73 | 10.68 | 10.30 |
| Br (kG) | 11.03 | 11.24 | 11.14 | 11.04 | 10.82 |
| BHmax (MGOe) | 29.1 | 30.2 | 28.3 | 26.7 | 24.1 |

EXAMPLE 2

Permanent magnets were produced in exactly the same manner as in Example 1 except that bismuth was used in amounts given in Table 2 in place of the aluminum used in Example 1.

The characteristics of the permanent magnets were as shown in Table 2.

TABLE 2

| Bi (wt %) | 0.5 | 1.0 | 1.4 | 2.0 | 2.5 |
|---|---|---|---|---|---|
| iHc (kOe) | 10.42 | 10.31 | 10.14 | 10.04 | 9.4 |
| Br (kG) | 11.04 | 11.20 | 11.30 | 11.25 | 11.14 |
| BHmax (MGOe) | 28.2 | 29.1 | 30.2 | 27.9 | 26.5 |

EXAMPLE 3

Permanent magnets were produced in exactly the same manner as in Example 1 except that thallium was used in amounts given in Table 3 in place of the aluminum used in Exmple 1.

The characteristics of the permanent magnets are shown in Table 3.

TABLE 3

| Tl (wt %) | 0.5 | 1.0 | 1.5 | 2.0 | 2.5 |
|---|---|---|---|---|---|
| iHc (kOe) | 10.92 | 10.81 | 10.70 | 10.56 | 10.47 |
| Br (kG) | 11.04 | 11.14 | 11.22 | 11.27 | 11.03 |
| BH (MGOe) | 27.3 | 28.1 | 29.2 | 30.5 | 26.7 |

As will be appreciated from Tables 1 through 3, in case of using the thallium, even if its content is 2.5 weight percent which exceeds of the upper limit of the B element, i.e. 2 weight percent, the residual magnetic flux density (Br) is improved and a great energy product can be obtained. However, the thallium is so expensive that its content as large as 2.5 weight percent significantly raises the manufacturing costs of permanent magnets; consequently, it is preferably, from the economical point of view, that the upper limit of the thallium content is 2 weight percent.

EXAMPLE 4

Alloys of 24.1 wt % samarium, 12.9 wt % iron, 3.9 wt % copper, 2 wt % manganese, zinc in amounts given in Table 4, 1.0 wt % aluminum and the balance cobalt prepared and permanent magnets were produced from the alloys in exactly the same manner as in Example 1.

The characteristics of the permanent magnets were as shown in Table 4.

TABLE 4

| Zn (wt %) | 0.6 | 1.0 | 2.0 | 3.0 | 4.0 | 5.0 | 6.0 | 7.0 |
|---|---|---|---|---|---|---|---|---|
| iHc (kOe) | 6.4 | 8.9 | 10.20 | 10.37 | 9.1 | 7.2 | 6.2 | 4.1 |
| Br (kG) | 11.41 | 11.35 | 11.26 | 11.19 | 11.07 | 10.91 | 10.74 | 10.37 |
| BHmax (MGOe) | 23.0 | 28.2 | 29.9 | 29.2 | 28.1 | 25.2 | 22.1 | 17.1 |

In cases where the zinc content is 0.5 and 6.0 weight percent, the maximum energy product (BHmax) somewhat decreases as shown in Table 4, but such values still are sufficient for practical applications. Since the zinc is low-cost, readily available in the market and easy to handle, its addition is preferable from the economical point of view and in terms of productivity.

EXAMPLE 5

An alloy of 24.1 wt % samarium, 12.9 wt % iron, 3.9 wt % copper, 2.0 wt % manganese, 1.1 wt % zinc, 0.9 wt % zirconium, 0.5 wt % aluminum, 0.1 wt % bismuth, 0.1 wt % thallium and the balance cobalt was prepared and a permanent magnet was produced in exactly the same manner as in Example 1.

The coercive force (iHc), the residual magnetic flux density (Br) and the maximum energy product (BHmax)

of this permanent magnet were 10.51, 11.10 and 29.4, respectively.

EXAMPLE 6

Permanent magnets were produced in exactly the same manner as in Example 5 except that the bismuth or thallium was not added.

The coercive force (iHc), the residual magnetic flux density (Br) and the maximum energy product (BHmax) of the permanent magnet with no bismuth were 10.49, 11.09 and 29.2, respectively. Also, the coercive force (iHc), the residual magnetic flux density (Br) and the maximum energy product (BHmax) of the permanent magnet with not thallium were 10.52, 11.07 and 29.3, respectively.

EXAMPLE 7

Alloys of 24.1 wt % samarium, 12.9 wt % iron, 3.9 wt % copper, manganese in amounts given in Table 5, 2.3 wt % zinc, 1.0 wt % aluminum and the balance cobalt were prepared and a permanent magnets were produced in exactly the same manner as in Example 1.

The characteristics of these permanent magnets are given in Table 5.

TABLE 5

| Mn (wt %) | 0.5 | 1.0 | 2.0 | 3.0 | 4.0 | 5.0 | 6.0 | 7.0 |
|---|---|---|---|---|---|---|---|---|
| iHc (kOe) | 10.50 | 10.32 | 10.14 | 10.04 | 10.01 | 9.98 | 9.04 | 7.9 |
| Br (kG) | 10.89 | 11.04 | 11.30 | 11.10 | 10.97 | 10.89 | 10.84 | 10.69 |
| BHmax | 28.1 | 29.2 | 30.2 | 29.7 | 29.1 | 28.4 | 27.5 | 24.7 |

TABLE 5-continued

| Mn (wt %) | 0.5 | 1.0 | 2.0 | 3.0 | 4.0 | 5.0 | 6.0 | 7.0 |
|---|---|---|---|---|---|---|---|---|
| (MGOe) | | | | | | | | |

As described above in detail, the present invention provides permanent magnet compositions having improved energy product by raising the residual magnetic flux density while maintaining the coercive force substantially at a level equal to that in the prior art compositions through use of aluminum, zinc and other elements which are low-cost, readily available and easy to handle. Thus, the present invention can remarkably reduce the manufacturing costs of permanent magnets.

Although the present invention has been described with reference to its preferred embodiments and examples, it will be apparent that many modifications and variations may be effected without departing from the scope of the novel concepts of the invention.

What is claimed is:

1. A permanent magnet composition comprising: 22 to 28 wt % R, R being at least one of rare earth elements including yttrium; 5 to 16 wt % iron; 0.2 to 6.5 wt % copper; 0.1 to 6 wt % manganese; 0.5 to 6 wt % A, A being at least one element selected from the group of zinc and zirconium; 0.1 to 2.5 wt % thallium; and the balance being cobalt.

2. A permanent magnet composition comprising 22 to 28 wt % R (which is at least one of the rare earth elements including yttrium), 5 to 16 wt % iron, 0.2 to 6.5 wt % copper, 0.1 to 6 wt % manganese, 0.5 to 6 wt % A (which is at least one of zinc and zirconium), 0.1 to 2 wt % aluminum, and the balance being cobalt.

* * * * *